United States Patent [19]

Komotzki

[11] Patent Number: 5,040,850

[45] Date of Patent: Aug. 20, 1991

[54] TOOL SUPPORTING STRUCTURE FOR USE IN MATERIAL REMOVING MACHINES

[76] Inventor: Michael Komotzki, Vöhdeweg 46, D-4607 Kamen-Heeren-Werve, Fed. Rep. of Germany

[21] Appl. No.: 580,958

[22] Filed: Sep. 11, 1990

[51] Int. Cl.[5] ..... F21C 35/18

[52] U.S. Cl. ..... 299/91; 299/93

[58] Field of Search ..... 299/79, 86, 91, 93; 37/142 R

[56] References Cited

U.S. PATENT DOCUMENTS 4,744,605 5/1988 Komotzki ..... 299/91

FOREIGN PATENT DOCUMENTS 3635018 2/1988 Fed. Rep. of Germany ..... 299/91

8805961 5/1988 Fed. Rep. of Germany .

*Primary Examiner*—Ramon S. Britts

*Assistant Examiner*—David J. Bagnell

*Attorney, Agent, or Firm*—Peter K. Kontler

[57] ABSTRACT

A tool supporting structure which can be used in a mining machine has a mobile base with a cylindrical opening, a socket which extends in the direction of movement of the base and is located downstream of the opening, and a projection extending counter to the direction of movement of the base and at right angles to the axis of the opening. The base cooperates with an L-shaped tool holder having an opening which is coaxial with the opening of the base, a protuberance which forms part of one leg of the holder and is snugly received in the socket of the base, and a recess which snugly receives the projections of the base. The shank of a tool extends into the aligned openings to prevent movements of the holder and base relative to each other in the axial direction of as well as at right angles to the openings. The base is further provided with a composite aperture which has two sections separated from each other by the socket, and the protuberance of the holder has an aperture which is located between and is aligned with the two sections of the aperture in the base to receive a pin-shaped retainer which is parallel to the shank of the tool and cooperates with the shank to prevent extraction of the protuberance from the socket and a movement of the recess away from the projection of the base.

5 Claims, 1 Drawing Sheet

TOOL SUPPORTING STRUCTURE FOR USE IN MATERIAL REMOVING MACHINES

BACKGROUND OF THE INVENTION

The invention relates to improvements in material removing machines, such as mining machines. More particularly, the invention relates to improvements in tool supporting structures which can be used in such machines. Typical examples of tools which can be held and supported by the structure of the present invention are bits which are used to remove rock or ore from mine faces and the like.

Commonly owned German Utility Model No. G 88 05 961.8 discloses a tool supporting structure which is used to retain the tool in proper position. The tool is mounted in a holder which is bolted to a mobile base. An axial extension of the holder is received in a recess of the base, and the base has a projection which is parallel to the axis of the tool and is received in a recess of the holder.

Reference may also be had to commonly owned U.S. Pat. No. 4,744,605 granted May 17, 1988 for "Bit and bit holder for mining machines."

OBJECTS OF THE INVENTION

An object of the invention is to provide a novel and improved combination of parts which can be used in a material removing (e.g., mining) machine to reliably hold the material removing tool in an optimum position for long periods of time but to permit convenient and rapid replacement of a damaged tool.

Another object of the invention is to provide a supporting structure which is capable of withstanding pronounced stresses irrespective of the direction of application of such stresses.

A further object of the invention is to provide a supporting structure wherein the tool is mounted in several parts.

An additional object of the invention is to provide a novel and improved method of assembling a base with a tool holder in a supporting assembly of the above outlined character.

Still another object of the invention is to provide a novel and improved base for use in the above outlined supporting assembly.

A further object of the invention is to provide a novel and improved tool holder for use in the above outlined supporting assembly.

Another object of the invention is to provide a supporting structure which constitutes an improvement over and a further development of the supporting structure described and shown in the commonly owned German Utility Model No. G 88 05 961.8.

SUMMARY OF THE INVENTION

The invention is embodied in a tool supporting and retaining structure which can be used with advantage in a material removing machine, particularly in a mining machine. The improved structure comprises a base which is movable in a predetermined direction when the machine is in use and has a first opening (preferably in the form of a cylindrical through hole or bore), a socket which extends at right angles to the opening and is located downstream of the opening (as seen in the predetermined direction) and a projection which extends at right angles to and is located upstream of the opening. The improved structure further comprises a tool holder having a protuberance which is received in the socket, a recess for the projection of the base and a second opening (preferably a cylindrical hole or bore) which is aligned with the first opening. The base and the protuberance have aligned apertures (e.g., in the form of cylindrical bores or holes) which are parallel to the openings and communicate with the socket. The shank of a material removing tool is receivable in the two openings and a retainer (e.g., a cylindrical pin or stud) is receivable in the apertures to cooperate with the shank of the tool by holding the base and the holder against movement relative to each other transversely of the shank. The protuberance is snugly received in the socket, and the projection is snugly received in the recess; this ensures that the base and the holder are held against movement relative to each other in the axial direction of the shank of the tool and in the axial direction of the retainer in the aligned apertures.

The holder can constitute an L-shaped body having a first leg which includes the protuberance and a second leg which is inclined relative to the first leg and is formed with the recess. The second leg is parallel to the axis of the shank.

The aperture of the base preferably includes two coaxial sections which are separated from each other by the socket, and the aperture of the protuberance is located between the two sections of the aperture in the base.

The projection can have a polygonal outline and has a plurality of external surfaces or facets abutting the adjacent internal surfaces provided on the holder and bounding the recess in the second leg.

The protuberance can have a polygonal outline and has a plurality of external surfaces or facets which abut the adjacent internal surfaces of the base in the aforementioned socket.

The novel features which are considered as characteristic of the invention are set forth in particular in the appended claims. The improved supporting structure itself, however, both as to its construction and the mode of assembling the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
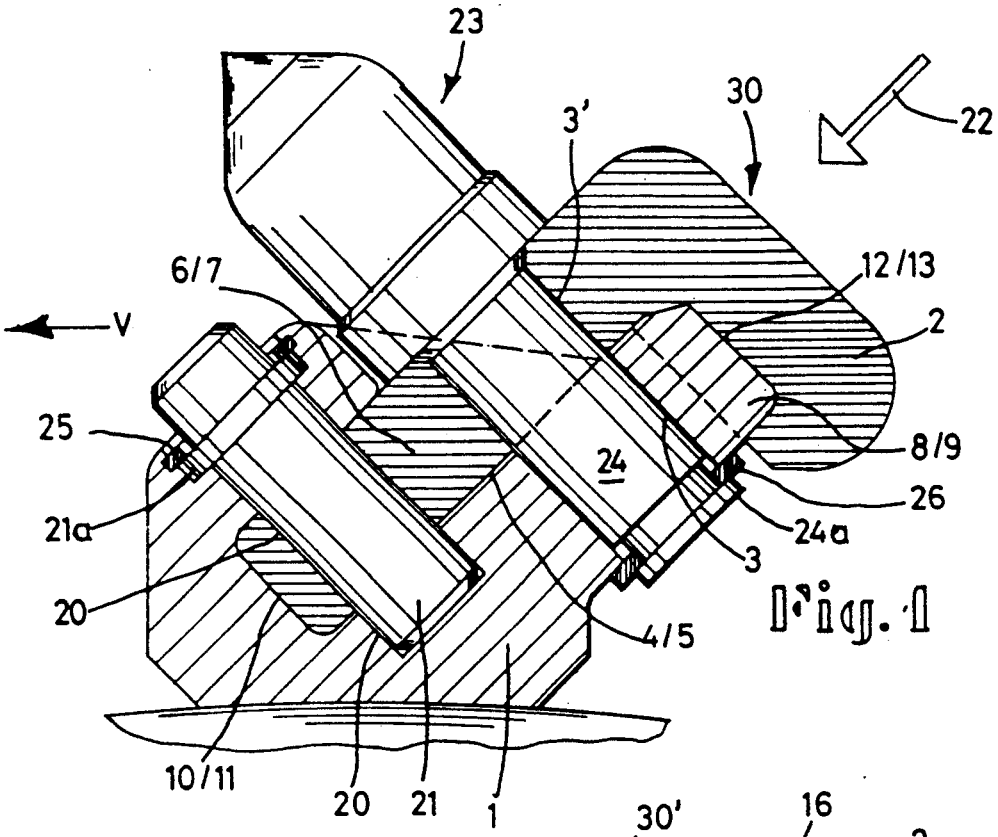
FIG. 1 is a sectional view of a supporting structure which embodies one form of the invention, the base, the holder, the tool and the retainer being shown fully assembled condition.

The structure which is shown in the drawing can be used in a material removing machine, such as a mining machine, to remove material from the mine face in an underground excavation or elsewhere. The material removing tool (e.g., a rotary bit) 23 has a stem or shank 24 which extends into and is retained in aligned first and second openings 3 and 3' respectively provided in a base 1 and in the longer leg 30' of a substantially L-shaped tool holder 2. The shorter leg 30 of the holder 2 is parallel to the axis of the opening 3 and is provided with a relatively shallow recess 8 which snugly receives a polygonal projection 9 of the base 1. When the machine is in use, the base 1 is assumed to advance in the direction of arrow V, i.e., the projection 9 is located upstream of or behind the openings 3 and 3'. The base has a relatively deep socket 6 which is located downstream of the openings 3, 3' and snugly receives a polygonal protuberance 7 constituting the foremost part of the leg 30'. The projection 9 and the socket 6 extend transversely of the common axis of the openings 3, 3' and are located substantially diametrically opposite each other.

Figure 2:
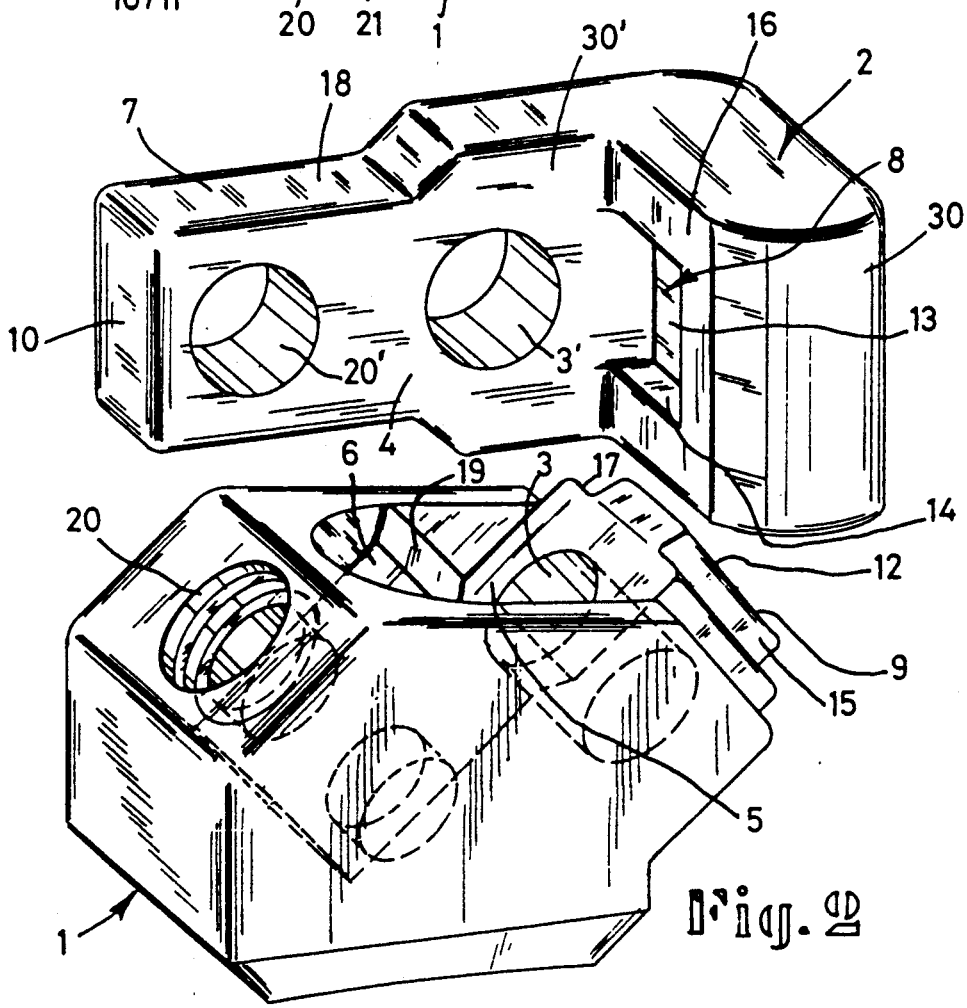
FIG. 2 is an exploded perspective view of the base tool holder, with the tool holder turned through approximately 90 degrees with reference to the position of FIG. 1.

The structure which is shown in FIGS. 1 and 2 further comprises a pin- or stud-shaped cylindrical retainer 21 which extends into aligned apertures 20, 20' in the base 1 and protuberance 7, respectively. The aperture 20 of the base 1 has two aligned sections which are separated from each other by the socket 6, and the aperture 20' of the protuberance 7 is located between the two sections of the aperture 20 The retainer 21 has an external collar 21*a* which is engaged by a split ring 25 serving to releasably retain the retainer in the aligned apertures 20 and 20'. A collar 24*a* at the rear end of the shank 24 is engaged by a split ring 26 which serves to releasably hold the tool 23 in the position shown in FIG. 1.

The holder 2 is interfitted with the base 1 in a first step in such a way that the projection 9 of the base extends into the recess 8 of the holder and the protuberance 7 of the holder extends into the socket 6 of the base. The next step involves insertion of the shank 24 into the openings 3, 3' and/or insertion of the retainer 21 into the apertures 20 and 20'. The split rings 25 and 26 are applied thereafter to complete the assembly of the novel structure which is then ready for use.

The polygonal projection 9 has a square or rectangular outline and is bounded by five external surfaces including four surfaces 15 and a surface 12. The leg 30 of the holder 2 has five internal surfaces which bound the recess 8 and include a surface 13 which abuts the surface 12 and four surfaces 14 which abut the respective external surfaces 15. The protuberance 7 has a square or rectangular outline and is bounded by five external surfaces including those shown at 4, 10 and 18. Such external surfaces abut the adjacent internal surfaces (including those shown at 5, 11 and 19) which are provided in the base 1 and surround the socket 6. As mentioned above, the projection 9 is a snug fit in the recess 8 and the protuberance 7 is a snug fit in the socket 6.

When the holder 2 is properly assembled with the base 1, these parts are held against movement relative to each other by a plurality of cooperating surfaces. Thus, the underside (external surface 4) of the protuberance 7 (as seen in FIG. 1) abuts the adjacent internal surface 5 of the base 1 in the socket 6. The external surface 10 of the protuberance 7 abuts the adjacent internal surface 11 of the base 1 in the deepmost portion of the socket 6. The external surface 12 of the projection 9 abuts the internal surface 13 of the holder 2 in the deepmost portion of the recess 8. The four external surfaces 15 of the projection 9 abut the adjacent internal surfaces 14 of the holder 2 in the recess 8.

The leg 30 of the holder 2 further comprises a U-shaped external surface 16 which surrounds three of the internal surfaces 14 and abuts a complementary external surface 17 of the base 1. The surface 18 of the protuberance 7 abut the adjacent internal surface 19 of the base 1 in the socket 6.

When the improved structure is fully assembled, the shank 24 of the tool 23 cooperates with the retainer 21 to prevent the holder 2 from moving relative to the base 1 counter to the direction which is indicated by the arrow 22. Any force acting counter to the direction of arrow 22 is taken up without any moments to thus ensure long-lasting and reliable retention of the tool 23 not only in the base 1 but also in the holder 2. The configuration of the base 1 and holder 2 is such that these parts are reliably held against any movement relative to each other in the direction of arrow 22 as well as in the axial direction of shank 24. In addition, the shank 24 cooperates with the retainer 21 to even more reliably prevent any angular movements of the holder and base relative to each other about the axis of the shank 24 and/or about the axis of the retainer 21. The only possible way to separate the holder 2 from the base 1 is to remove the retainer 21 and the tool 23 and to thereupon move the holder 2 counter to the direction which is indicated by the arrow 22.

An important advantage of the improved supporting structure is that it need not employ any externally and/or internally threaded parts. Moreover, the retainer 21 assists the shank 24 of the tool 23 in preventing the only possible movement of the holder 2 relative to the base 1, namely counter to the direction which is indicated by the arrow 22. Still further, a simple split ring 25 suffices to hold the retainer 21 against expulsion from the apertures 20 and 20' because the retainer is not subjected to any (or any appreciable) axial stresses.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a material removing machine, the combination of a base movable in a predetermined direction and having a first opening, a socket extending at right angles to said opening and being located downstream of said opening in the direction of movement of said base, and a projection extending transversely of and being located upstream of said opening; a tool holder having a protuberance extending into said socket, a recess for said projection and a second opening aligned with said first opening, said base and said protuberance having aligned apertures parallel to said openings and communicating with said socket and said openings being arranged to receive a shank of a material removing tool; and a retainer received in said apertures and cooperating with the shank in said openings to hold said base and said holder against movement relative to each other transversely of the shank, said protuberance and said projection being snugly received in said socket and in said recess, respectively, to hold said base and said holder against movement relative to each other in the axial direction of the shank.

2. The structure of claim 1, wherein said holder comprises a first leg which includes said protuberance and a second leg which is inclined relative to said first leg and includes said recess.

3. The structure of claim 1, wherein the aperture of said base has two spaced apart coaxial sections which are separated from each other by said socket and the aperture of said protuberance is disposed between said sections.

4. The structure of claim 1, wherein said projection has a polygonal outline and includes a plurality of external surfaces, said holder having internal surfaces provided in said recess, one for each of said external surfaces and each abutting the respective external surface.

5. The structure of claim 1, wherein said protuberance has a polygonal outline and includes a plurality of external surfaces, said base having a plurality of internal surfaces in said socket, one for each of said external surfaces and each abutting the respective external surface.

* * * * *